United States Patent [19]

Bean

[11] 4,310,873

[45] Jan. 12, 1982

[54] KEY HOLE LIGHT ILLUMINATOR

[76] Inventor: Stanley R. Bean, 2067 Lake Club Tr., Columbus, Ohio 43227

[21] Appl. No.: 133,114

[22] Filed: Mar. 24, 1980

Related U.S. Application Data

[63] Continuation of Ser. No. 913,215, Jun. 6, 1978, abandoned.

[51] Int. Cl.[3] ..... E05B 17/10

[52] U.S. Cl. ..... 362/100; 362/186; 362/800

[58] Field of Search ..... 362/100, 800, 186

[56] References Cited

U.S. PATENT DOCUMENTS 4,037,221 7/1977 Alexander ..... 362/100 X

*Primary Examiner*—Stephen J. Lechert, Jr.

*Attorney, Agent, or Firm*—Anthony D. Cennamo

[57] ABSTRACT

A structure for mounting adjacent a key hole, having means therein for illuminating said key hole. The outside cover provides a large area contact surface for activating the light. The circuitry is updated electronic components to provide a touch contact switch and a short period timer. The battery is a voltage cell and the light is a light emitting diode.

5 Claims, 10 Drawing Figures

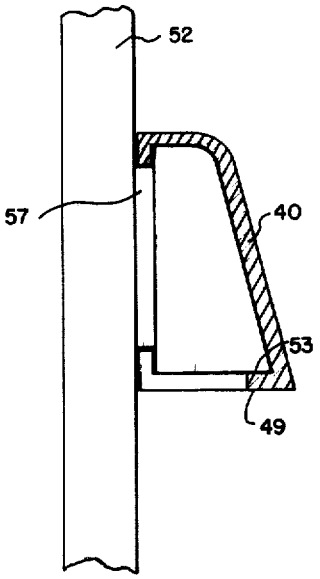
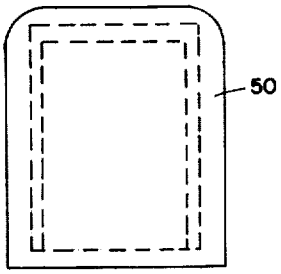
FIG. 2
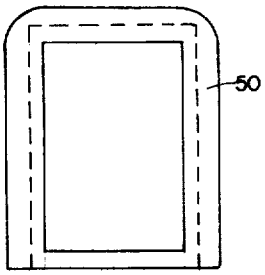
FIG. 3
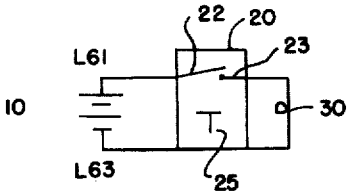
FIG. 8
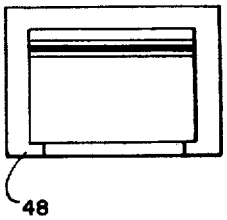
FIG. 7B
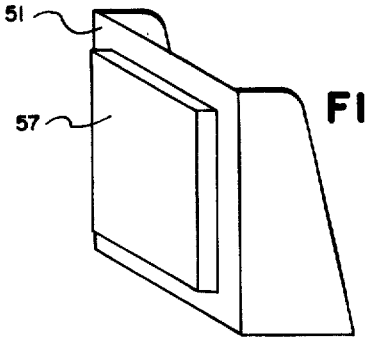
FIG. 7C
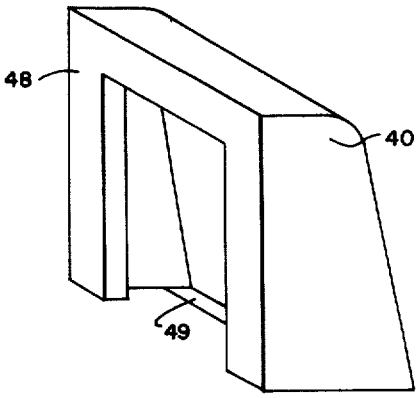

KEY HOLE LIGHT ILLUMINATOR

This is a continuation of Ser. No. 913,215, filed June 6, 1978 now abandoned.

BACKGROUND OF INVENTION

Illumination for a key hole dates back in the prior art before the turn of the century. Generally the illumination is direct—the key hole per se is illuminated or surrounded by an illuminating means; or indirect where there is an auxiliary light with a reflector to direct the light upon the key hole area.

In the indirect illumination of a key hole there is found in the prior art many such means wherein the light is not continuously illuminated. In these, the illumination is actuated by a switch.

Again, many of these indirect systems are self-powered. Success has not, for one reason or another, come to these prior art systems. Mostly they are crude and either are lighted at all times from house current or dependent upon batteries and the actuating switches are of the mechanically activated on/off type. Further, although a switch may be easier to locate than a key hole, the normal switch is not the answer for ready accessability.

Typical of the prior art are U.S. Pat. Nos. 2,529,234, 2,661,417, 2,011,692, 3,590,234, 3,270,191, 3,711,694, all now reclassified in Class 362/100 of the United States Patent Office Classification System.

SUMMARY OF INVENTION

The present invention is for a key light illuminate of the switch battery type. The improvements primarily resides in the exterior housing, the simplified electronic circuitry, the illumination means, and a timing means. Particularly, the overall housing is of a resilient material and may be touched lightly at any place for activation of the light. The switch is a capacitance type of contact in an electronic circuitry having a simplified short-time timing means; the light is a light emitting diode (LED), and the battery is a voltage cell. The overall housing completely encloses and substantially seals all of the elements—including the light—to free the entire structure from the elements. But yet, the front cover, although in sealing engagement with the remaining of the housing, is readily removed for the infrequent change in components.

Objects

It is accordingly a principal object of the present invention to provide a new and improved illumination means for a key hole that circumvents the attendant disadvantages of the prior art.

A further object of the present invention is to provide such an illumination means that may be readily actuated for illumination for a short period of time.

Another object of the present invention is to provide such an illumination means that utilizes the advantages of the state of art electronic components.

Further objects and features of the present invention will become apparent from the following detailed description when taken in conjunction with the drawings in which:

BRIEF DESCRIPTION OF DRAWINGS

FIG. 2 is a front view of the embodiment of FIG. 1.

FIG. 3 is a back view of the embodiment of FIG. 1.

FIGS. 7, 7A, 7B, and 7C illustrate in various views the outside housing of the preferred embodiment, and FIG. 8 is a schematic illustrating electrically the components of the present invention.

DETAILED DESCRIPTION OF THE INVENTION

Figure 1:
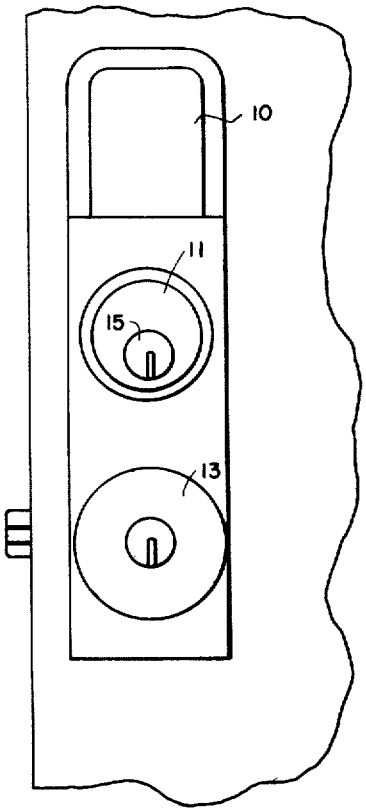
FIG. 1 is a front view and FIG. 1A is a side view of the preferred embodiment of the present invention in an application with a typical door lock.
Figure 1A:
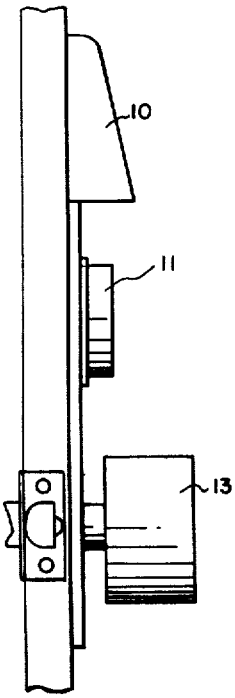

Referring particularly to FIG. 1 there is illustrated the preferred embodiment in its simplest application, together with a typical door lock. A typical door will include a door knob/latch 13 that may or may not include a lock, and a lock 11 having a key insert hole 15. To assure proper illumination of the key hole, the light 10 of the present invention is positioned strategically about the key hole 15 and door knob 12.

Figure 5:
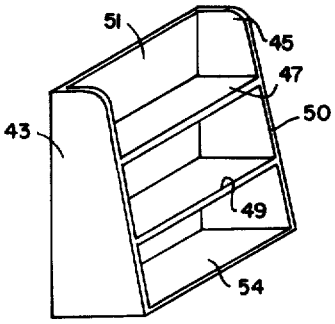
FIG. 5 is an isometric view of the structure supporting the components of the present invention.
Figure 4:
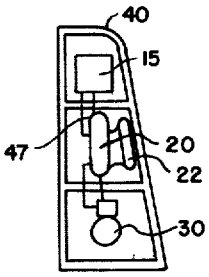
FIG. 4 is a side view of the preferred embodiment of the present invention with the side panel removed.
Figure 6:
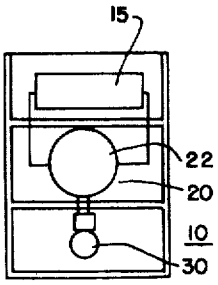
FIG. 6 is a front view of the structure supporting the components of the present invention.

With reference to FIG. 4 with the side removed for illustration and FIG. 6 with the front cover removed from the overall structure 10 to expose the primary elements, and FIG. 5 the supporting structure for the elements of the present invention. They include the voltage source 15, the switch 20, the illuminator 30, and the resilient cover 40, FIG. 3, and the supporting structure 50 including the transparent bottom cover 54.

With particular reference to FIG. 5, the supporting structure 50 comprises a back plate 51 and parallel side plates 43 and 45. Together with the transparent bottom plate 54 and the resilient cover 40 (FIG. 2). The overall housing 50 comprises a complete enclosure.

Referring now to FIGS. 7, 7A, 7B, and 7C, to assure that the entire assembly is sealed; but yet, wherein the cover plate 40 may be readily removed from the housing 50, the back plate 51 also includes a second and adjoining plate 57. The second plate 57 is not as long nor as wide as the plate 51, thereby leaving a spacing on top and sides between the plate 51 and the door structure 52 upon which the structure is mounted.

The resilient outside cover 40 includes a reentrant portion 48 at its upper and side rear end and a right angle portion 49 at its front lower end. In this way the reentrant portion 48 of the coverplate 40 is inserted into the spacing between the plate 51 and the structure 52. The cover plate 40 is then pushed in causing the right angle portion 49 to be resiliently secured to the underside of the supporting structure 53 for the transparent bottom cover 54.

Similarly the edges 53 of the structure 50 are forced into resilient contact with the inside edge of the cover 40.

To remove the cover 40 from the structure 50 the bottom portion 49 is slightly pulled out, the entire cover may be then slided upwardly and removed.

Referring again to FIGS. 4, 5, and 6, there is illustrated also the structural arrangement of the components mounted in the housing 50, that does form a part of the preferred embodiment of the present invention.

Initially, it is to be noted all components—including the light source 30, are completely enclosed within the housing. The illumination from source 30 is provided through the bottom transparent panel 54.

The switch 20 has an omni-directional contact 22 of an overall size sufficient for relatively easy actuation. Specifically switch contact 22 has a disc-like surface. Bracket support means 47 fixed to the inside of the housing 50 supports the switch 20 in position wherein the contact surface of disc 22 is positioned adjacent to the inside of the cover 40 as shown in FIG. 4. In this way, it can be appreciated that a finger touch in the center of the resilient cover 40 will in turn actuate the disc contact 22. The structural positioning of the remaining components is of no real consequence.

With particular reference to FIG. 8 there is illustrated schematically in block the circuit of the present invention.

The switch 20 is a two part switch comprising a voltage line connector 23 and a timer 25. Accordingly, actuation of switch 20, via contact 22, causes the voltage lines L 61 and L63 between the voltage source 10 and the illuminator 30 to be in contact. Additionally, the switch 20 upon contact of the voltage Lines L 61 and 63 initiates the timer 25 preset to a predetermined time. Upon completion of the time cycle the timer automatically removes the contact of the voltage lines from the voltage source 10 to the illuminator 30.

The timer 25 in the preferred embodiment is electronic and may be constructed from electronic circuit chips in a conventional manner.

The switch 30 in the preferred embodiment is electronically actuated in contrast to a mechanical switch. These switches are available commercially such as the capacitance and microswitch types.

The voltage source 10 in the preferred embodiment is not a conventional battery. Since the voltage source is outside—although completely enclosed, a battery would not have the desired life. There are commercially available voltage cells providing a longer life than batteries. Again the contacts of a conventional battery subject to corrosion and the like would further quicken the break down time whereas with a voltage cell the mechanical connections are minimized.

The illuminator 30, in the preferred embodiment is preferably a light emitting diode (LED). It has been found that such a light requires considerably less voltage/current and is for immediate actuation more responsive. Depending on its application and the amount of light required, in certain instances a light other than the light emitting diode may be utilized.

Although certain and specific embodiments of the present invention have been shown and described, it is understood that modifications may be had thereto, without departing from the true spirit and scope of the invention.

What is claimed:

1. A unitized structure for illuminating a point-source area, such as a key hole, comprising:

a housing for mounting adjacent said area;

electrical components for providing said illumination fixedly positioned within said structure;

a cover of resilient material removably positioned in sealing engagement with said structure;

said electrical components further including a switch having an oversize contact positioned adjacent the inside wall of said resilient cover;

a voltage cell and an illuminator interconnected and disconnected by said switch; and a timer associated with said switch to connect said voltage cell to said illuminator for a present time and thereafter disconnect the same.

2. The illuminator structure of claim 1 wherein said mounting structure further includes a transparent bottom.

3. The illuminator structure of claim 1 wherein said illuminator is a light emitting diode.

4. The illuminator structure of claim 1 wherein said housing comprises a two part back and wherein the part between the other part and the structure wherein it is mounted, has a lesser diameter in width and length.

5. The illuminator structure of claim 4 wherein said resilient cover includes a right angle edge on the sides and bottom, and a reentrant portion at its top, adapted to be slidingly inserted over said housing in the area between said two part back.

* * * * *